US009417576B2

(12) United States Patent
Minamishima et al.

(10) Patent No.: US 9,417,576 B2
(45) Date of Patent: Aug. 16, 2016

(54) FIXING DEVICE

(71) Applicant: CANON KABUSHIKI KAISHA, Tokyo (JP)

(72) Inventors: Yasuhito Minamishima, Odawara (JP); Toru Imaizumi, Kawasaki (JP); Takashi Narahara, Mishima (JP); Atsutoshi Ando, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/833,445

(22) Filed: Aug. 24, 2015

(65) Prior Publication Data

US 2016/0062281 A1 Mar. 3, 2016

(30) Foreign Application Priority Data

Aug. 29, 2014 (JP) ..... 2014-175037

(51) Int. Cl.
*G03G 15/20* (2006.01)

(52) U.S. Cl.
CPC ..... *G03G 15/206* (2013.01)

(58) Field of Classification Search
CPC . G03G 15/2039; G03G 15/205; G03G 15/55; G03G 15/2053; G03G 2215/2035
USPC ..... 399/33
See application file for complete search history.

(56) References Cited

U.S. PATENT DOCUMENTS 6,323,460 B1 * 11/2001 Ohtsuka ..... G03G 15/2064 219/121.69
6,336,009 B1 * 1/2002 Suzumi ..... G03G 15/2042 399/67
7,177,579 B2 2/2007 Uchida et al.
7,209,696 B2 4/2007 Umezawa et al.
7,389,079 B2 6/2008 Narahara et al.
7,428,390 B2 9/2008 Ando
7,512,370 B2 * 3/2009 Shimizu ..... G03G 15/2064 399/122
7,570,895 B2 8/2009 Ando et al.
7,792,448 B2 9/2010 Ando et al.
7,953,359 B2 5/2011 Kobayashi et al.
8,331,819 B2 12/2012 Fukuzawa et al.
8,670,702 B2 3/2014 Ikegami et al.

(Continued)

FOREIGN PATENT DOCUMENTS

JP 8-63017 A 3/1996
JP 10-142977 A 5/1998

(Continued)

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A fixing device for fixing a toner image on a recording material includes: a cylindrical film; a plate-like heater contacting an inner surface of the film; a roller for forming a nip in cooperation with the heater through the film; and a thermo-sensitive member for detecting the temperature of the heater to interrupt electric power supply to the heater when the temperature of the heater reaches an abnormal temperature. The heater has a heat generating pattern symmetric with respect to a center line thereof extending in a direction perpendicular to a recording material feeding direction. The thermo-sensitive member is provided in a side which is opposite from a surface of the heater contacting the inner surface of the film and which is downstream of the center line of the heater with respect to the recording material feeding direction.

12 Claims, 5 Drawing Sheets

(56) References Cited

U.S. PATENT DOCUMENTS

| | | | | |
|---|---|---|---|---|
| 8,712,303 | B2 | 4/2014 | Ando et al. | |
| 8,744,296 | B2 | 6/2014 | Fukuzawa et al. | |
| 8,971,744 | B2 | 3/2015 | Nihonyanagi et al. | |
| 9,002,249 | B2 | 4/2015 | Uekawa et al. | |
| 2002/0057919 | A1* | 5/2002 | Tomatsu | G03G 15/2039 399/69 |
| 2006/0133868 | A1 | 6/2006 | Kobayashi et al. | |
| 2012/0148283 | A1* | 6/2012 | Sano | G03G 15/2053 399/69 |
| 2012/0315069 | A1* | 12/2012 | Ikeda | G03G 15/0189 399/341 |
| 2013/0045032 | A1* | 2/2013 | Shimokawa | G03G 15/2053 399/329 |
| 2014/0186078 | A1 | 7/2014 | Imaizumi et al. | |
| 2014/0212190 | A1* | 7/2014 | Takeuchi | G03G 15/2053 399/329 |
| 2015/0023704 | A1 | 1/2015 | Imaizumi et al. | |
| 2015/0227091 | A1 | 8/2015 | Ando et al. | |

FOREIGN PATENT DOCUMENTS

| | | | |
|---|---|---|---|
| JP | 2006-171630 | A | 6/2006 |
| JP | 2012-078678 | A | 4/2012 |

* cited by examiner

FIXING DEVICE

FIELD OF THE INVENTION AND RELATED ART

The present invention relates to a fixing device suitable for an electrophotographic image forming apparatus in which a toner image formed on a recording material by using an electrophotographic image forming process is fixed on the recording material by heat-melting the toner image. Examples of the electrophotographic image forming apparatus include an electrophotographic copying machine, an electrophotographic printer (laser beam printer, LED printer or the like), and so on.

As a conventional fixing device to be mounted in the image forming apparatus of an electrophotographic type, there is a fixing device including a heater as a heating member including a heat generating resistor on a ceramic substrate. This fixing device further includes a fixing film as a film-like fixing member rotating in contact with the heater and a pressing roller as a rotatable pressing member to be pressed against the fixing film toward the heater. The recording material carrying an unfixed toner image is heated at a press-contact portion (hereinafter referred to as a fixing nip) formed by pressing the pressing roller against the fixing film toward the heater while being nipped and fed through the fixing nip, so that the toner image on the recording material is heat-fixed on the recording material.

This fixing device has such an advantage that the time required from the start of energization (electric energy (power) supply) to the heater until the temperature of the heater increases up to a fixable temperature is short. Accordingly, a printer in which the fixing device is mounted is small in electric power consumption during stand-by in which the printer waits for a print instruction, so that the time from after input of the print instruction until an image formed on a first sheet is outputted can be shortened.

In the fixing device of the film heating type as described above, as a means for improving a toner image fixing property in an electric power saving manner, a constitution in which a pressing center line of a pressing roller is provided downstream of a center line of a heater with respect to a recording material feeding direction has been proposed (Japanese Laid-Open Patent Application 2006-171630).

In such a fixing device, in preparation for generation of an abnormal temperature rise of the heater, a thermo-sensitive member (thermo-switch, temperature fuse or the like) for interrupting energization to a heat generating resistor is provided. In general, the thermo-sensitive member is, as shown in FIG. 8, disposed on a back surface of the heater at a central portion with respect to the recording material feeding direction. Further, energization to the heater is controlled so that the temperature of the thermo-sensitive member during normal use is not more than the temperature (normal usable temperature) determined in view of the risk that an unintended operation (energization interruption) is generated.

However, in the fixing device disclosed in Japanese Laid-Open Patent Application 2006-171630, in the case where an upstream end of the heater protrudes outward from the fixing nip, in order to suppress the temperature of the thermo-sensitive member so as to be not more than the normal usable temperature, there is a need to further suppress the energization to the heater. For this reason, the fixing film temperature decreases, so that a fixing property and glossiness of an output image decreases as specifically described below.

That is, in the above-described fixing device, in order to reduce the thermal capacity for the purpose of downsizing the fixing device and shortening the first-print-out time of the device, the diameter of the pressing roller is made small in some cases. In the cases, with respect to the recording material feeding direction, the fixing nip narrows, and therefore the heater upstream end protrudes outward from the fixing nip in some cases. In the cases, during normal use, in an upstream side of the heater, the amount of heat conduction to the pressing roller via the fixing nip decreases, and therefore the degree of temperature rise becomes large.

For that reason, the degree of temperature rise of the thermo-sensitive member disposed on the back surface of the heater becomes large, so that the temperature exceeds a normal usable temperature, and therefore an unintended operation (energization interruption) is liable to be caused to occur. In order to obviate this operation of the thermo-sensitive member, although there is a need to control the temperature of the heater during normal use at a certain temperature or less, the temperature of the fixing film decreases and thus sufficient heat cannot be given to the toner image, and therefore the fixing property and the glossiness of the output image decrease.

Further, as a means for solving this problem, in the case where a heat generating resistor pattern is disposed so that heat generation of the heater is suppressed more in the upstream side than in the downstream side or in the case where the resistance of a heat generating resistor is charged between the upstream side and the downstream side, the following problem arises. That is, in the case where a remarkably large abnormal temperature rise generates, during stopping of the fixing device, a difference in thermal stress in the ceramic substrate of the heater with respect to the recording material feeding direction, there is a possibility that the difference leads to breakage of or a crack in the heater.

SUMMARY OF THE INVENTION

According to an aspect of the present invention, there is provided a fixing device for fixing a toner image on a recording material by heating the recording material on which the toner image is formed while feeding the recording material. The fixing device comprises: a cylindrical film; a plate-like heater contacting an inner surface of the film; a roller for forming a nip in cooperation with the heater through the film; and a thermo-sensitive member for detecting the temperature of the heater to interrupt electric power supply to the heater when the temperature of the heater reaches an abnormal temperature. The heater has a heat generating pattern symmetric with respect to a center line thereof extending in a direction perpendicular to a recording material feeding direction. The thermo-sensitive member is provided in a side which is opposite from a surface of the heater contacting the inner surface of the film and which is downstream of the center line of the heater with respect to the recording material feeding direction.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described with reference to the drawings.

First Embodiment

Fixing Device

Figure 1:
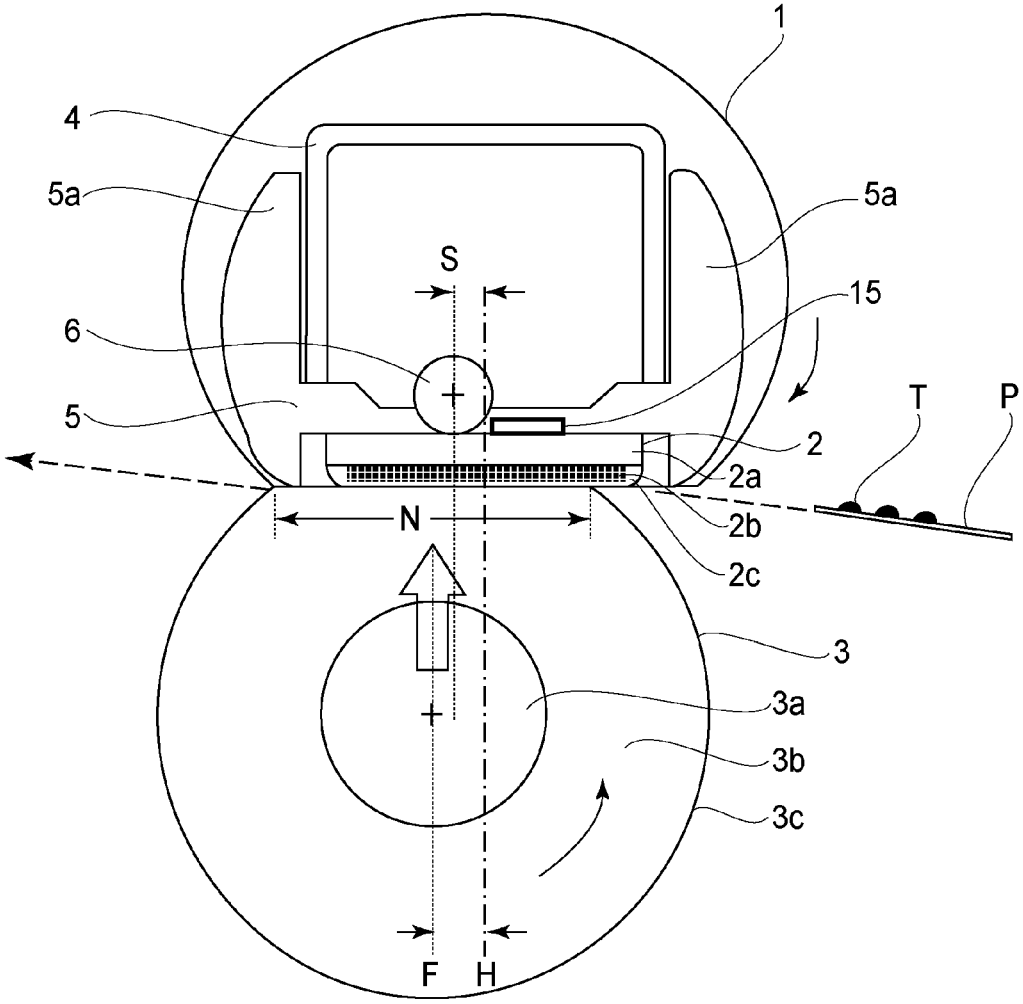
FIG. 1 is a schematic view showing a fixing device according to a First Embodiment of the present invention.

The structure of a direction according to a First Embodiment of the present invention will be described using FIG. 1. This fixing device is used for heat-fixing a toner image formed by an image forming method of a general electrophotographic type. From a right side on the drawing sheet of FIG. 1, a recording material P on which a toner image T is carried is fed by an unshown feeding means and passes through the fixing device, so that the toner image T is heat-fixed.

The fixing device of a film heating type in this embodiment includes a cylindrical fixing film 1, as a first rotatable member, having flexibility, and includes a plate-like heater 2 contacting an inner surface of the fixing film 1. The fixing device further includes a pressing roller 3 as a second rotatable member pressed against the fixing film 1 toward the heater 2. The heater 2 and the pressing roller 3 opposing the fixing film 1 cooperate to form a fixing nip N where the recording material is nipped and fed.

The thickness of the fixing film 1 may preferably be 20 μm or more and 60 μm or less in order to ensure a good heat conduction property. As the fixing film 1, a single-layer film of a material such as PTFE, PFA or PPS or a composite-layer film obtained by coating a surface of a base layer of a material such as polyimide, polyamideimide, PEEK or PES with a parting layer of a material such as PTFE, PFA or FEP may suitably be used.

Further, another composite-layer film obtained by using a base layer of pure metal, such as SUS, Al, Ni, Cu or Zn or an alloy thereof, which has a high-heat-conductive property and then by coating the base layer with the above-described parting layer or with a fluorine-containing resin tube as a parting layer may also be suitably used. In this embodiment, as the fixing film 1, a film obtained by subjecting a polyimide base layer of 18 mm in inner diameter and 50 μm in thickness to coating with PFA to form an about 15 μm-thick parting layer was used.

The heater 2 contacting the inner surface (a position corresponding to the fixing nip N) of the fixing film 1 includes an elongated heater substrate 2*a* extending in a longitudinal direction. As the substrate 2*a*, an insulating ceramic substrate of alumina, aluminum nitride or the like, or a heat-resistant resin substrate of polyimide, PPS, a liquid crystal polymer or the like is used. On one surface of the substrate 2*a*, along the longitudinal direction, a heat generating resistor 2*b* of Ag/Pd (silver/palladium), $RuO_2$ or $Ta_2N$ is coated and formed by screen printing or the like.

For the purposes of protecting the heat generating resistor 2*b* and of ensuring insulation of the heat generating resistor 2*b*, an insulating protective layer 2*c* formed of, e.g., glass, polyimide or the like is provided on one surface of the substrate 2*a* so as to cover the heat generating resistor 2*b*. A temperature detecting element 15 such as a thermistor contacts a back surface (opposite from the surface in a side corresponding to the fixing nip N) of the heater substrate 2*a*, and depending on a detection temperature of this temperature detecting element 15, energization to the heat generating resistor 2*b* is controlled.

The pressing roller 3 includes a metal core 3*a* of a material such as iron or aluminum, an elastic layer 3*b* of a material such as silicone rubber, and a parting layer 3*c* of a material such as PFA. In this embodiment, the silicone rubber layer is formed in a thickness of 3.5 t on the iron-made core metal of 11 mm in diameter, and thereon, a 40 μm-thick PFA tube is coated. The hardness of the pressing roller 3 was 55° as measured by Asker-C hardness meter under a load of 1 kg.

A heater holder 5 as a back-up member is formed of a heat-resistant resin material such as the liquid crystal polymer, PPS or PEEK, and engages with a fixing stay 4 held at longitudinal end portions thereof by a (fixing) device frame. Then, a pressing spring (not shown) as a pressing means presses the longitudinal end portions of the stay 4, whereby the heater holder 5 is pressed toward the pressing roller 3 side.

The fixing stay 4 as the back-up member uses a rigid material such as iron, stainless steel, SUM or "ZINKOTE" (zinc-coated) steel plate in order to uniformly apply a pressure, received at a longitudinal ends thereof, in a longitudinal direction of the heater holder 5, and a cross-sectional shape thereof is made a U-character shape, so that rigidity thereof is enhanced. As a result, in a state in which flexure of the heater holder 5 is suppressed, between the heater holder 5 and the pressing roller 3, the fixing nip N is formed.

In this embodiment, as the material for the heater holder 5, the liquid crystal polymer is used, and as the material for the fixing stay 4, the "ZINKOTE" steel plate is used. Further, the pressure applied to the pressing roller 3 is 180 N, and at this time, a width of the fixing nip N with respect to the recording material feeding direction is about 6 mm.

The pressing roller 3 forming the fixing nip N in cooperation with the heater 2 and the heater holder 5 rotates in an arrow direction by receiving power from an unshown motor. By rotation of the pressing roller 3, the fixing film 1 is rotated in an arrow direction at a certain speed. In this embodiment, a rotational speed of the motor was set so that a recording material feeding speed is 40 mm/sec. The heater holder 5 not only forms the fixing nip N in cooperation with the pressing roller 3 while holding the heater 2 but also has the function as a guide for guiding rotation of the fixing film 1 by ribs 5*a*.

In the fixing device described above, the recording material P is nipped and fed in the fixing nip N, whereby the unfixed toner image T on the recording material P is heat-fixed on the recording material P.

Heater

Figure 2:
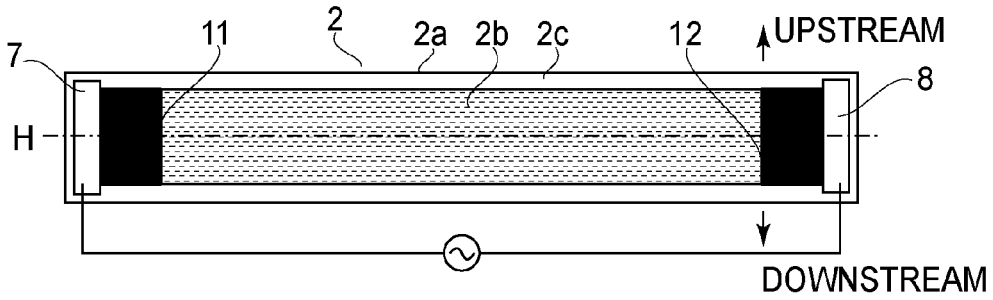
FIG. 2 is a schematic view showing a heater pattern in the fixing device in the First Embodiment.

In the fixing device in this embodiment, as shown in FIG. 2, on the basis of a center line with respect to the recording material feeding direction, the heater 2 provided continuously from an upstream side to a downstream side is used. As the material for the substrate 2*a*, alumna is employed, and thereon, the heat generating resistor 2*b* of Ag/Pd is provided. Further, a substrate size is 6.5 mm in width with respect to the recording material feeding direction, 270 mm in longitudinal length and 1 mm in thickness. Electrodes 7 and 8 are provided at longitudinal end portions of the substrate 2*a*, and a pattern of the heat generating resistor 2*b* is linearly formed. In FIG. 2, a left end of the heat generating resistor 2*b* and the electrode 7 are connected by an electroconductive member 11, and a right end of the heat generating resistor 2*b* and the electrode 8 are connected by an electroconductive member 12.

The width of the heat generating resistor 2*b* is 5.5 mm, and the distance from an upstream end of the substrate 2*a* with respect to the recording material feeding direction and an upstream end of the heat generating resistor 2*b* with respect to the recording material feeding direction is 0.5 mm. The heat generating resistor 2*b* is disposed symmetrically with respect to a heater center line H corresponding to a center line of the substrate 2*a* with respect to the recording material feeding direction.

Feature of this Embodiment

The heater 2 is formed so that a heat generation amount is the same between an upstream side and a downstream side on the basis of the center line with respect to the recording material feeding direction. The upstream end of the heater 2 protrudes from the upstream end of the fixing nip N, i.e., the upstream end of the heater 2 is positioned in a side upstream of the upstream end of the fixing nip N.

Further, with respect to the recording material feeding direction, a pressing center line F passing through a position of a rotational axis of the pressing roller 3 is shifted toward a side downstream of the center line of the substrate of the heater 2 by 1.2 mm. For this reason, the center line of the heater 2 is shifted toward a side upstream of the center line passing through the rotational axis of the pressing roller 3, so that the upstream end of the heater 2 protrudes from the fixing nip N.

A temperature fuse 6 as a thermo-sensitive member is disposed in contact with the back surface of the heater 2. The temperature fuse 6 as the thermo-sensitive member interrupts supply of electric power to the heater 2 when the temperature of the heater 2 reaches an abnormal temperature. A center line S of the temperature fuse 6 with respect to the recording material feeding direction is disposed in a side downstream of the center line H of the heater 2 (specifically by 0.5 mm) as described later with respect to the reason therefor. An operation temperature of the temperature fuse 6 is 228° C., and a normal usable temperature is determined as 215° C.

Action of this Embodiment

Figure 3:
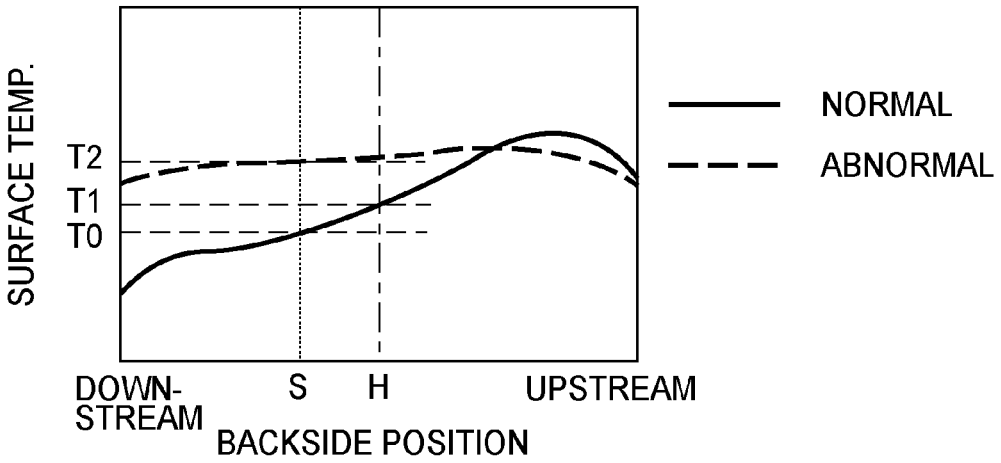
FIG. 3 is a graph showing a heater back surface temperature distribution in the fixing device in the First Embodiment.

A schematic diagram of a temperature distribution at the back surface of the heater 2 in the fixing device is shown in FIG. 3. The temperature distribution indicated by a solid line represents normal use in which the fixing device is driven and the recording material is fed while controlling energization so that the temperature of the heater 2 becomes the desired temperature. The temperature distribution indicated by a broken line represents an abnormal temperature rise in which the electric power is supplied during stop of the fixing device i.e., when the temperature fuse 6 operates.

During normal use, compared with the upstream side, the back surface temperature of the heater 2 decreases in the downstream side. This is because the pressing center line F is disposed downstream of the heater center line H and thus a contact area between the heater 2 and the film 1 is larger in the downstream side than in the upstream side, and therefore heat is taken from the heater 2 toward the pressing roller 3 in a larger amount in the downstream side than in the upstream side. At this time, with respect to the heater back surface temperature, a temperature T1 at the heater center line H is 220° C. which exceeds the normal usable temperature, and on the other hand, a temperature T0 of the temperature fuse center line S is 215° C., i.e., is controlled so as to full within a range of not more than the normal usable temperature.

In this embodiment, the temperature fuse 6 as the thermo-sensitive member is shifted from the heater center line H along which the temperature fuse 6 has been conventionally disposed to the downstream center line S, whereby the electric power supplied to the heater 2 is increased compared with that in the conventional fixing device while maintaining the temperature of the temperature fuse 6, and thus the fixing film 1 is used at a higher temperature. This will be specifically described below.

Figure 4:
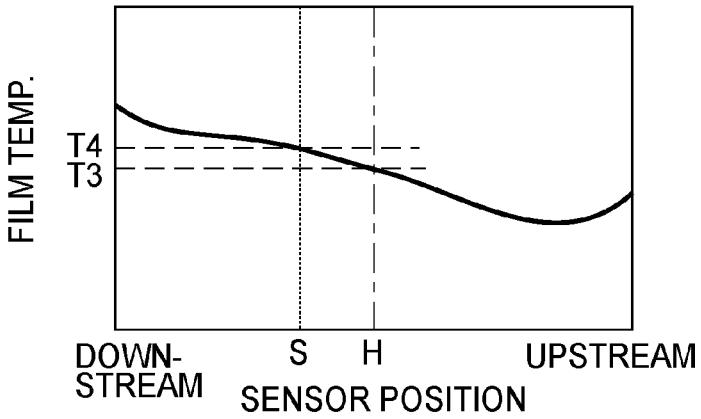
FIG. 4 is a graph showing a relationship between a thermosensitive member arrangement position and a fixing film temperature in the First Embodiment.

FIG. 4 is a graph showing a relationship between the fixing film temperature and a position of the thermo-sensitive member with respect to the recording material feeding direction in the case where the temperature measured at a single point on the back surface of the heater 2 is set at 215° C. In FIG. 4, the reason why the fixing film temperature is lower in the upstream side than in the downstream side with respect to the recording material feeding direction is as follows. That is, as shown in FIG. 3, the heater back surface temperature is higher in the upstream side than in the downstream side and therefore necessary electric power supplied to the heater 2 when the temperature is controlled at 215° C. is small, and therefore the fixing film temperature decreases.

Here, the fixing film temperature is a temperature when glossy paper is passed through the fixing device in an environment of room temperature of 15° C. and a humidity of 10% RH. Incidentally, the necessary electric power supplied to the heater when the temperature is controlled at 215° C. is determined on the basis of the position (with respect to the recording material feeding direction) and a detection temperature of the temperature detecting element 15 so that the temperature of the temperature fuse 6 as the thermo-sensitive member corresponds to 215° C. The position of the temperature detecting element 15 with respect to the recording material feeding direction can be arbitrarily set, and in FIG. 1, for convenience, the temperature detecting element 15 is provided at a position adjacent to the thermo-sensitive member in the upstream side, but the temperature detecting element 15 can also be disposed at a central portion of the heater 2, for example.

At the conventional heater central position H where the thermo-sensitive member (temperature fuse) is disposed, a fixing film temperature T3 when the energization is controlled so that a target temperature is 215° C. was 180° C. On the other hand, at a position S where the thermo-sensitive member (temperature fuse) in this embodiment is disposed, a fixing film temperature T4 increases to 185° C. This is because the heater back surface temperature is lower in the downstream side than in the upstream side with respect to the recording material feeding direction (FIG. 3), and therefore the necessary electric power supplied to the heater 2 when the temperature control is effected at 215° C. is larger in the downstream side than in the upstream side, so that the fixing film temperature becomes larger (FIG. 4).

In the above-described fixing device, heat can be supplied to the toner image T on the recording material P by the fixing film higher in temperature, and therefore it became possible to obtain higher degrees of a fixing property and image glossiness. Specifically, in the fixing device described above, when the image glossiness during passing of the glossy paper carrying thereon the toner image was measured, in the case where energization was controlled so that the temperature at the heater center line H was 215° C. as in the conventional constitution, the image glossiness was 60. On the other hand, in the case where energization was controlled so that the temperature at the temperature fuse center line S was 215° C. as in this embodiment, the image glossiness was increased to 65.

For measurement of the image glossiness, a gloss meter ("PG-2", manufactured by Nippon Denshoku Industries Co., Ltd.) is used. The paper carrying thereon the toner image was passed through the fixing device, and an image obtained by once applying an adhesive tape onto an output image and then by peeling off the adhesive tape was compared. In the conventional constitution, the image was largely destroyed, and on the other hand, in the constitution of this embodiment, the image was improved to the extent that a point-peeling-off of about 0.5 mm in diameter generated.

On the other hand, during an abnormal temperature rise, the back surface temperature of the heater 2 shown in FIG. 3 is substantially flat at a temperature T2 of 228° C. at the temperature fuse center line S, so that the temperature difference between the temperature fuse center line S and the heat center line H is very small. This is because compared with the temperature distribution during normal use, a time from electric power application is short and the pressing roller 3 is at rest and therefore an amount of heat conduction to the pressing roller 3 is small. For this reason, during an during abnormal temperature rise, the degree of the temperature rise of the temperature fuse 6 is comparable to that in the conventional constitution, and therefore it is possible to interrupt the energization to the heater 2 before a heat substrate crack (breakage) is caused to occur.

In this embodiment, due to layout constraint of the fixing device, the position of the temperature fuse center line S was 0.5 mm downstream of the position of the heater center line H. In a fixing device in which the position of the temperature fuse center line S can be made further downstream of the position of the heater center line H, the above-described functional effect can be obtained in a larger degree, and it is possible to use the fixing film 1 at a higher temperature.

As described above, in this embodiment, the pressing center line F is disposed downstream of the heater center line H, and the temperature fuse 6 as the thermo-sensitive member is disposed downstream of the heater center line H in contact with the heater 2. As a result, the temperature rise of the temperature fuse 6 during normal use is suppressed and thus the fixing film 1 can be used at a higher temperature, and therefore it is possible to obtain higher degrees of the fixing property and the image glossiness.

Second Embodiment

Figure 5:
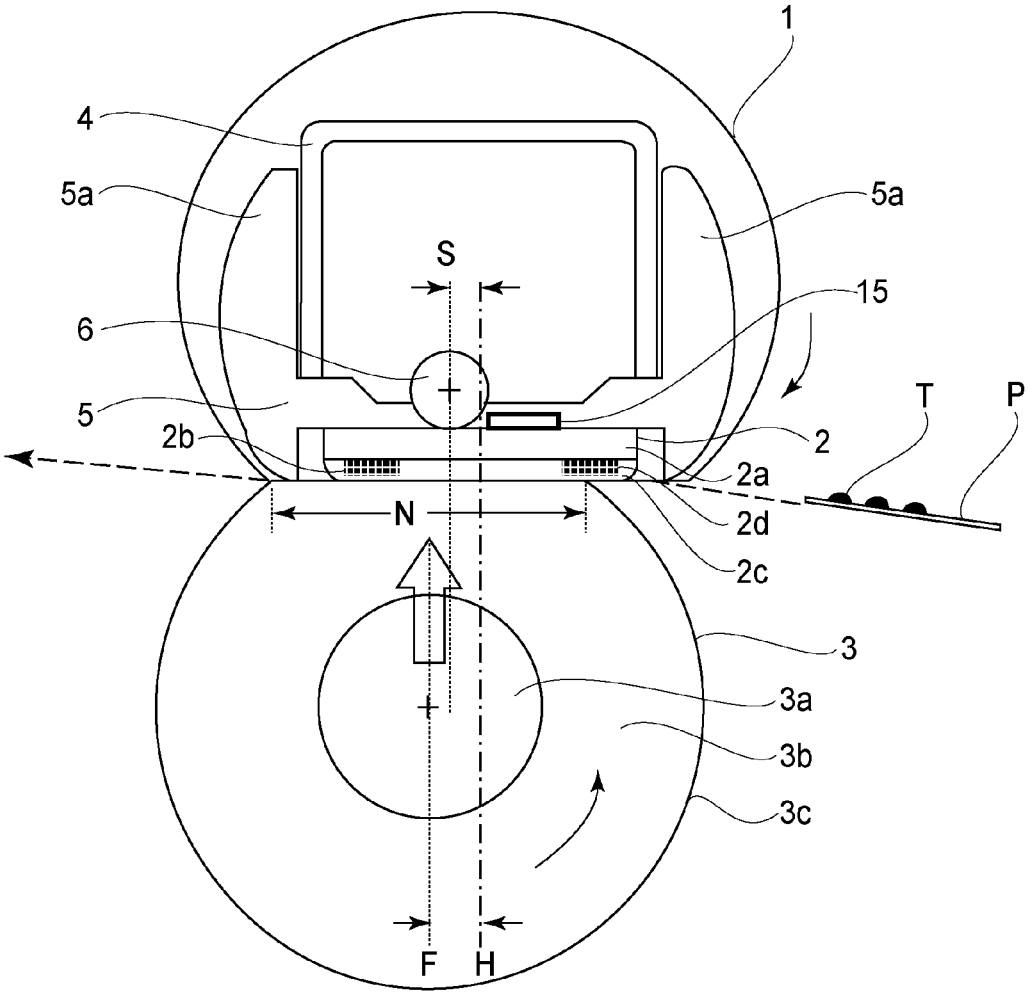
FIG. 5 is a schematic view showing a fixing device according to a Second Embodiment of the present invention.

The structure of a fixing device according to a Second Embodiment of the present invention will be described using FIG. 5. The constitution is common to the fixing devices in this embodiment and Embodiment 1 except for the following point, and therefore a redundant description of common structures will be omitted. In this embodiment, heat generating resistors 2*b* and 2*d* are provided in a plurality of regions of the heater with respect to the recording material feeding direction (i.e., the heater is divided and provided in the upstream side and the downstream side on the basis of a center line with respect to the recording material feeding direction), so that the effect shown in the First Embodiment can be obtained in a larger degree.

Feature of this Embodiment

Figure 6:
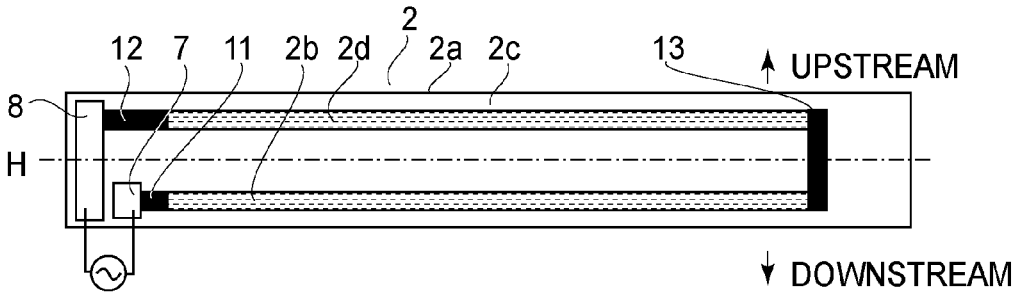
FIG. 6 is a schematic view showing a heater pattern in the fixing device in the Second Embodiment.

In the fixing device in this embodiment, the heater 2 shown in FIG. 6 is used. The materials for respective members and the size of the substrate 2*a* are common to First Embodiment and Second Embodiment. Electrodes 7 and 8 are provided at one longitudinal end portion (left side in FIG. 6) of the substrate 2*a*, and a pattern of each of a heat generating resistor 2*b* (second heat generating resistor) and a heat generating resistor 2*d* (first heat generating resistor) is linearly formed in parallel. In FIG. 6, a left end of the heat generating resistor 2*b* and the electrode 7 are connected by an electroconductive member 11, and a left end of the heat generating resistor 2*d* and the electrode 8 are connected by an electroconductive member 12. A right end of the heat generating resistor 2*b* and a right end of the heat generating resistor 2*d* are connected by an electroconductive member 13.

The width of each of the heat generating resistor 2*b* and the heat generating resistor 2*d* is 1.0 mm, and the distance from an upstream end of the substrate 2*a* with respect to the recording material feeding direction and the upstream end of the heat generating resistor 2*d* with respect to the recording material feeding direction is 0.5 mm, and the distance from the downstream end of the substrate 2*a* to the downstream end of the heat generating resistor 2*b* with respect to the recording material feeding direction is 0.5 mm. These (two) heat generating resistors are disposed symmetrically with respect to the heat center line H. As a result, the heat generating resistors are formed so that a heat generation amount is the same between the upstream side and the downstream side on the basis of the heater center line with respect to the recording material feeding direction. That is, the heater 2 has a symmetric heat generation pattern with respect to the center line H of the heater 2 along the recording material feeding direction.

On the other hand, with respect to the recording material feeding direction, the pressing center line F of the pressing roller F is shifted downstream of the substrate center line of the heater 2 by 1.2 mm. For this reason, the upstream end of the heater 2 protrudes from the upstream end of the fixing nip N. A part of the heat generating resistor 2*d* protrudes from the fixing nip N. An entirety of the heat generating resistor 2*d* may also protrude from the fixing nip N.

A temperature fuse 6 is disposed in contact with the back surface of the heater 2. A center line S of the temperature fuse 6 with respect to the recording material feeding direction is disposed in a side downstream of the center line H of the heater 2 by 0.5 mm. The temperature fuse 6 openable at 228° C. is used.

Action of this Embodiment

Figure 7:
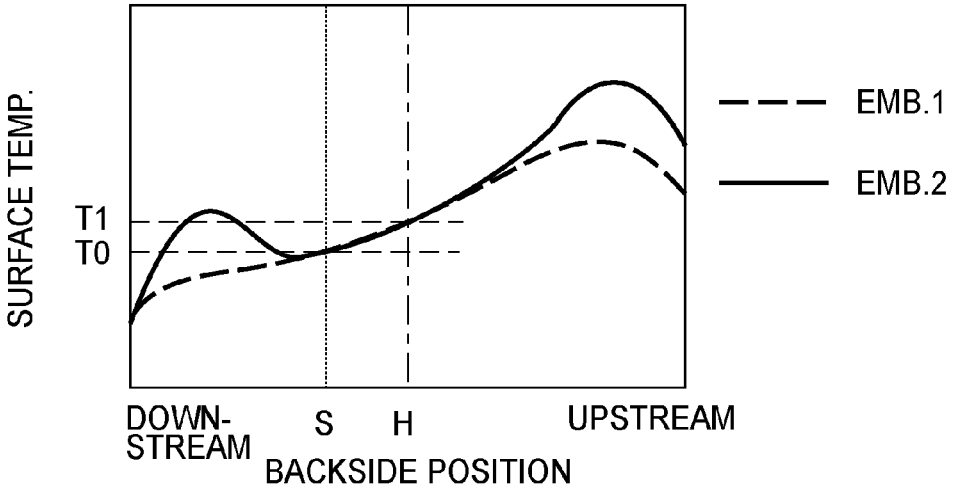
FIG. 7 is a graph showing a heater back surface temperature distribution in the fixing device in the Second Embodiment.
Figure 8:
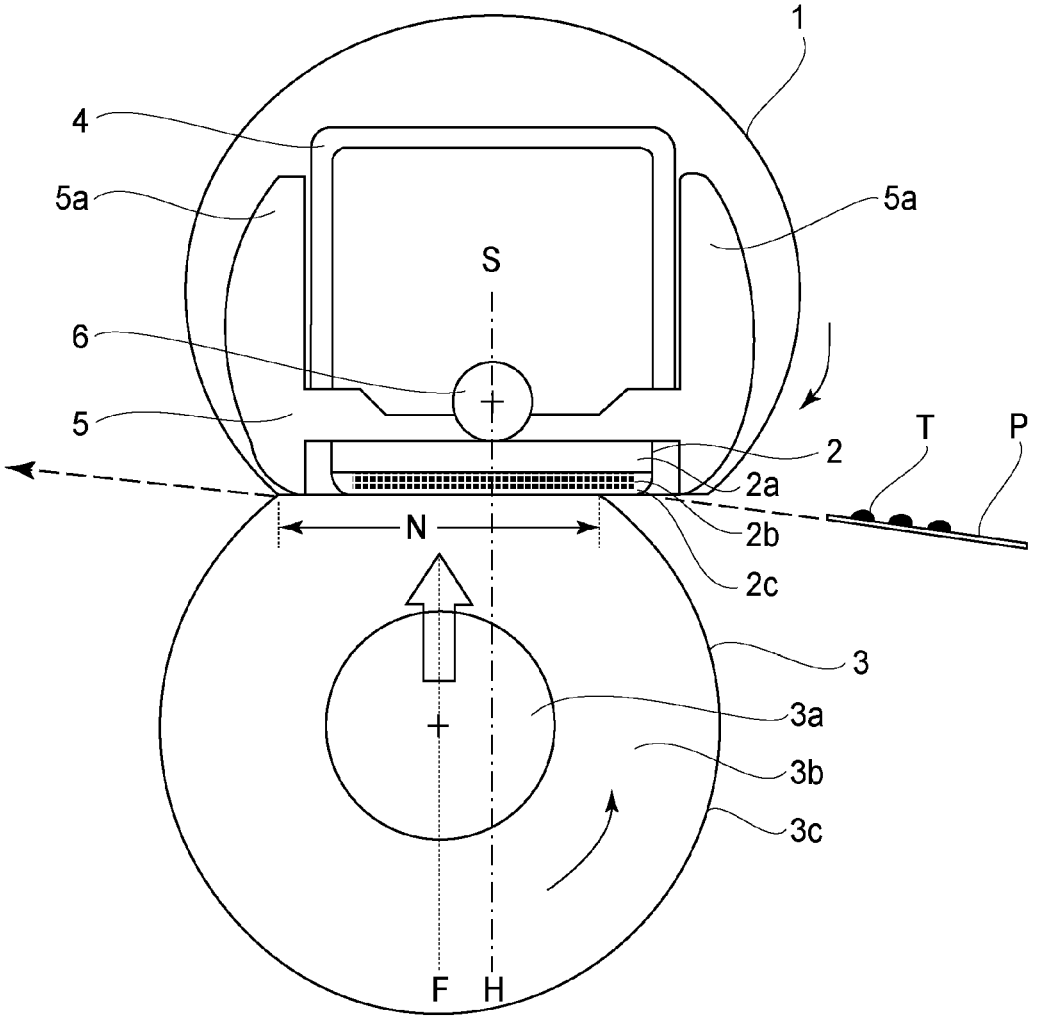
FIG. 8 is a schematic sectional view of a conventional fixing device.

A schematic diagram of a temperature distribution at the back surface of the heater 2 in the fixing device is shown in FIG. 7. The temperature distribution indicated by a solid line is that during normal use in this embodiment (Second Embodiment). The temperature distribution indicated by a broken line is that during normal use in First Embodiment.

During normal use, similarly as in the First Embodiment, the back surface temperature of the heater 2 decreases from the upstream side toward the downstream side. Further, in this embodiment, the temperatures in the neighborhoods of the upstream end and the downstream end of the heater substrate are increased compared with those in the First Embodiment. This is attributable to a difference in heat generation amount between a central portion where there is no heat generating resistor and the neighborhood of the downstream-side heat generating resistor 2*b*. At this time, although, a temperature T1 at the heater center line H is 220° C. which exceeds the normal usable temperature, a temperature T0 of the temperature fuse center line S is 215° C., i.e., is controlled so as to full within a range of not more than the normal usable temperature.

In the above-described fixing device, by providing the heat generating resistors at positions other than the temperature fuse position on the heater 2, the fixing film 1 is used at a temperature higher than the temperature in the First Embodiment. This is because the heat generation amount in the neighborhood of each of the upstream end and the downstream end of the heater 2 increases, and in this embodiment, the fixing film temperature when the glossy paper was passed through the fixing device in an environment of room temperature of 15° C. and a humidity of 10% RH was increased to 190° C.

Also, in the fixing device described above, when the image glossiness during passing of the glossy paper carrying thereon the toner image was measured, the output image glossiness in the First Embodiment was 65, and on the other hand, the output image glossiness in this embodiment was increased to 70. The paper carrying thereon the toner image was passed through the fixing device, and an image obtained by once applying an adhesive tape onto an output image and then by peeling off the adhesive tape was compared. In the First Embodiment, the point-peeling-off of about 0.5 mm in diameter generated, and on the other hand, in this embodiment, there was no first breakage (peeling-off).

In this embodiment, a largest functional effect is obtained by disposing the thermo-sensitive member at a minimum position S of the temperature distribution shown in FIG. 7, so that the fixing film 1 can be used at a higher temperature. This minimum position S of the temperature distribution is positioned downstream of the heater center line H and upstream of the upstream end of the downstream-side heat generating resistor (heat generating resistor 2*b*). In this embodiment, due to layout constraint of the fixing device, the position of the temperature fuse center line S was 0.5 mm downstream of the position of the heater center line H. In a fixing device in which the temperature fuse can be disposed closer to the minimum of the temperature distribution, the above-described functional effect can be obtained in a larger degree, and it is possible to use the fixing film 1 at a higher temperature.

As described above, in this embodiment, with respect to the recording material feeding direction on the heater 2, there is no heat generating resistor at the central portion, and the plurality of the heat generating resistors are disposed separately and symmetricly with respect to the center line in the upstream side and the downstream side, respectively.

Further, the pressing center line F is disposed downstream of the heater center line H, and the temperature fuse 6 is disposed downstream of the heater center line H in contact with the heater 2. As a result, the temperature rise of the temperature fuse 6 during normal use is remarkably suppressed and thus the fixing film 1 can be used at a higher temperature, so that it is possible to obtain higher degrees of the fixing property and the image glossiness.

Modified Embodiments

In the above, the preferred embodiments of the present invention are described, but the present invention is not limited to these embodiments, and can be variously modified and changed within the scope thereof. For example, in the above-described embodiments, the heat generation pattern is symmetric between the upstream side and the downstream side, but the present invention is not limited thereto. Even when the heat generation pattern is not symmetric between the upstream side and the downstream side, but the present invention is not limited thereto. Even when the heat generation pattern is not symmetric between the upstream side and the downstream side, the heater temperature during rotation of the rotatable member can be made lower in the side upstream of the center of the heater than in the side downstream of the center of the heater with respect to the recording material feeding direction. This is attributable to the fact that the pressure by the roller is weaker in the upstream side of the heater than in the downstream side of the heater and thus heat is less taken in the upstream side than in the downstream side.

In such a situation, by disposing the thermo-sensitive member in a side downstream of the central portion of the heater, temperature rise of the thermo-sensitive member during normal use is suppressed. For this reason, the fixing member can be controlled at a high temperature without causing an unintended operation (energization interruption) of the thermo-sensitive member. As a result, heat can be supplied in a larger amount to the toner image, so that it becomes possible to improve the fixing property and the glossiness of the output image.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-175037 filed on Aug. 29, 2014, which is hereby incorporated by reference herein in its entirety.

What is claimed is:

1. A fixing device for fixing a toner image on a recording material by heating the recording material on which the toner image is formed while feeding the recording material, said fixing device comprising:

a cylindrical film;

a nip forming member including a heater configured to contact an inner surface of said film, said heater being provided so that an upstream end of said heater protrudes from a nip and a downstream end of said heater is inside the nip with respect to the recording material feeding direction;

a roller configured to form the nip in cooperation with said nip forming member through said film; and a thermo-sensitive member configured to interrupt electric power supply to said heater when the temperature of said heater reaches an abnormal temperature, wherein said thermo-sensitive member is provided on said nip forming member so as to sense the heat of a downstream area of said heater which is downstream of a center of said heater with respect to the recording material feeding direction.

2. The fixing device according to claim 1, wherein said heater includes a substrate, a first heat generating resistor provided upstream of a center of said substrate with respect to the recording material feeding direction, and a second heat generating resistor which is provided downstream of the center of said substrate with respect to the recording material feeding direction and which has the same resistance value as said first heat generating resistor.

3. The fixing device according to claim 2, wherein said heater includes no heat generating resistor between said first heat generating resistor and said second heat generating resistor.

4. The fixing device according to claim 2, wherein said thermo-sensitive member is provided upstream of said second heat generating resistor with respect to the recording material feeding direction.

5. The fixing device according to claim 2, wherein at least a part of said first heat generating resistor protrudes from the nip.

6. The fixing device according to claim 1, wherein in a period in which a fixing process is performed, with respect to the recording material feeding direction, the temperature of the downstream area of said heater is lower than that of the center of said heater.

7. The fixing device according to claim 1, wherein said thermo-sensitive member is a fuse or a thermo-switch.

8. A fixing device for fixing a toner image on a recording material by heating the recording material on which the toner image is formed while feeding the recording material, said fixing device comprising:

a cylindrical film;

a nip forming member including a heater configured to contact an inner surface of said film;

a roller configured to form a nip in cooperation with said nip forming member through said film; and a thermo-sensitive member configured to interrupt electric power supply to said heater when the temperature of said heater reaches an abnormal temperature, wherein said heater is provided so that the temperature of a center of said heater, while said film and said roller are rotating and the electrical power is supplied to said heater, is higher than the temperature of a downstream area of said heater, which is downstream of the center of said heater in the recording material feeding direction and so that the temperature difference between the center of said heater and the downstream area of said heater, while said film and said roller stops rotating and the electrical power is supplied to said heater, is smaller than the temperature difference while said film and said roller are rotating and the electrical power is supplied to said heater, and wherein said thermo-sensitive member is provided on said nip forming member so as to sense the heat of the downstream area of said heater.

9. The fixing device according to claim 1, wherein said heater includes a substrate which is made from alumina.

10. The fixing device according to claim 8, wherein said heater includes a substrate which is made from alumina.

11. The fixing device according to claim 1, wherein said heater has a heat generating pattern symmetric with respect to the center of said heater in the recording material feeding direction.

12. The fixing device according to claim 8, wherein said heater has a heat generating pattern symmetric with respect to a center of said heater in a direction perpendicular to a recording material feeding direction.

* * * * *